US009795221B2

(12) United States Patent
Osimo

(10) Patent No.: US 9,795,221 B2
(45) Date of Patent: Oct. 24, 2017

(54) INFLATABLE LOUNGE CHAIR AND METHODS OF MANUFACTURING SAME

(71) Applicant: Aqua-Leisure Industries, Inc., Avon, MA (US)

(72) Inventor: Paul Osimo, Providence, RI (US)

(73) Assignee: Aqua-Leisure Industries, Inc., Avon, MA (US)

( * ) Notice: Subject to any disclaimer, the term of this patent is extended or adjusted under 35 U.S.C. 154(b) by 0 days.

(21) Appl. No.: 15/215,772

(22) Filed: Jul. 21, 2016

(65) Prior Publication Data

US 2017/0020296 A1 Jan. 26, 2017

Related U.S. Application Data

(60) Provisional application No. 62/195,218, filed on Jul. 21, 2015.

(51) Int. Cl.

| | |
|---|---|
| ***A47C 15/00*** | (2006.01) |
| ***A47C 4/54*** | (2006.01) |
| ***A47C 1/14*** | (2006.01) |

(52) U.S. Cl.

CPC ..... *A47C 15/006* (2013.01); *A47C 1/146* (2013.01); *A47C 4/54* (2013.01)

(58) Field of Classification Search

CPC .. A47C 4/54; A47C 3/16; A47C 1/146; A47C 15/006

USPC ..... 297/452.41; 441/66, 40, 130

See application file for complete search history.

(56) References Cited

U.S. PATENT DOCUMENTS

| | | | | | |
|---|---|---|---|---|---|
| D182,647 | S | * | 4/1958 | Cox | 297/452.13 |
| D187,313 | S | | 2/1960 | Denyer | |
| 3,056,980 | A | * | 10/1962 | Holladay | A47C 27/081 156/292 |
| 3,156,483 | A | * | 11/1964 | See | A47C 27/081 280/18 |
| 3,253,861 | A | * | 5/1966 | Howard | A47C 7/021 297/229 |
| 3,408,107 | A | * | 10/1968 | Savage | A47C 4/54 297/391 |
| D216,448 | S | | 1/1970 | Vasilatos | |
| 3,499,682 | A | | 3/1970 | Orenstein | |
| 3,540,776 | A | * | 11/1970 | Wilson | A47C 4/54 297/253 |
| 3,584,914 | A | | 6/1971 | Williams | |
| 3,899,210 | A | | 8/1975 | Samhammer et al. | |
| 4,011,611 | A | | 3/1977 | Lederman | |
| D244,569 | S | | 6/1977 | Laroye | |
| D289,075 | S | | 3/1987 | Wolfe | |
| D302,719 | S | | 8/1989 | Hance et al. | |
| D350,326 | S | | 9/1994 | Grifflin | |
| 5,360,360 | A | | 11/1994 | Peterson | |

(Continued)

OTHER PUBLICATIONS

[No Author Listed] lntex Green Inflatable Beanless Bag Chair. Amazon. https://www.amazon.com/lntex-Green-lnflatable-Beanless-Chair/dp/B005KOAUFK [posted Aug. 30, 2011, retrieved Jul. 29, 2016].

(Continued)

*Primary Examiner* — Milton Nelson, Jr.

(74) *Attorney, Agent, or Firm* — Wolf, Greenfield & Sacks, P.C.

(57) ABSTRACT

This invention relates to recreational flotation devices, and particularly to inflatable lounge chairs, and to methods for manufacturing same.

10 Claims, 6 Drawing Sheets

(56) References Cited

U.S. PATENT DOCUMENTS

| | | | | |
|---|---|---|---|---|
| D395,759 | S | 7/1998 | Smith | |
| 5,947,563 | A | 9/1999 | Klimenko | |
| 6,152,530 | A | 11/2000 | Hsu et al. | |
| 6,161,902 | A | 12/2000 | Lieberman | |
| D441,205 | S | 5/2001 | Hsu et al. | |
| 6,224,444 | B1 | 5/2001 | Klimenko | |
| 6,328,385 | B1 | 12/2001 | Lau | |
| D488,530 | S | 4/2004 | Peterson | |
| 6,746,293 | B1 | 6/2004 | Kirby, Jr. et al. | |
| 6,886,204 | B2 * | 5/2005 | Kasatshko | A47C 4/54 297/452.41 |
| D541,058 | S | 4/2007 | Dykstra | |
| D549,298 | S | 8/2007 | Peterson | |
| D552,205 | S | 10/2007 | Peterson | |
| D554,224 | S | 10/2007 | Peterson | |
| D554,379 | S | 11/2007 | Weber et al. | |
| D554,727 | S | 11/2007 | Peterson | |
| D561,861 | S | 2/2008 | Boutin | |
| D591,064 | S | 4/2009 | Lee et al. | |
| D600,029 | S | 9/2009 | Paulin | |
| D628,400 | S | 12/2010 | Duchaufour | |
| D653,464 | S | 2/2012 | Ou | |
| 8,336,964 | B2 | 12/2012 | Cho | |
| D731,197 | S | 6/2015 | Lee | |
| 2003/0117005 | A1 | 6/2003 | Becker et al. | |
| 2003/0151295 | A1 | 8/2003 | Nelson | |
| 2007/0061977 | A1 | 3/2007 | Zheng | |

OTHER PUBLICATIONS

[No Author Listed] Ozone Neutron Inflatable Audio Chair. Ubergizmo. http://www.ubergizmo.com/2008/02/ozone-neutron-inflatable-audio-chair/ [retrieved Jul. 29, 2016].

[No Author Listed] WOW World of Watersports Salon Lounge Single. Hayneedle. http://www.hayneedle.com/product/worldofwatersportssalonloungesingle.cfm [retrieved Aug. 22, 2016].

[No Author Listed] Wink Air Island—Coussin Nomade Gonflable—Wink!. http://www.piscines-hydrosud.fr/jeux-piscine/fauteuil-gonflable/5363-wi nk-air-island-coussin-nomade-gonflable-lot-de-2.html#.V_5dDP1VigU [retrieved Sep. 30, 2016].

* cited by examiner

INFLATABLE LOUNGE CHAIR AND METHODS OF MANUFACTURING SAME

RELATED APPLICATIONS

This application claims priority under 35 U.S.C. §119(e) to U.S. Provisional Patent Application Ser. No. 62/195,218 filed Jul. 21, 2015 and entitled "METHOD FOR MANUFACTURE OF FLOATING LOUNGE CHAIR," which is incorporated herein by reference in its entirety for all purposes.

TECHNICAL FIELD

This invention relates to recreational flotation devices, and particularly to inflatable lounge chairs, and to a method for manufacturing same.

BACKGROUND

Floating mattress, lounges, and the like are among the most popular beach and pool recreational devices. They typically comprise a relatively planar bladder that may have an inflatable raised portion, or pillow, at one end. More elaborate devices may take the shape of a chair that floats upright so that the user may assume a seated position. The manufacture of some known inflatable lounge chairs requires more than 20 welds and a custom welding table.

Accordingly, there is a need for alternative inflatable lounge chairs and methods of manufacturing the same to reduce and simplify the manufacturing steps required to make them.

SUMMARY

This invention relates to recreational flotation devices, and particularly to inflatable lounge chairs, and to a method for manufacturing same.

Inflatable lounge chairs are generally described. According to one or more embodiments, the inflatable lounge chair may comprise first and second planar sheets, each comprising: an interior section; a periphery; and first and second cut-out portions proximate the periphery, each of the first and second cut-out portions comprising first and second edges defining a notch. The chair may further comprise a peripheral seam securing the first and second planar sheets at their peripheries. The first and second planar sheets may be folded such that the first and second edges of the first cut-out portions of each of the first and second planar sheets are in proximity with and secured to each other, and such that the first and second edges of the second cut-out portions of each of the first and second planar sheets are in proximity with and secured to each other.

Methods of manufacturing an inflatable lounge chair are provided. According to one or more embodiments, the method may comprise the following steps: aligning a periphery of a first planar sheet with a periphery of a second planar sheet, wherein first and second cut-out portions of each of the first and second planar sheets each comprise first and second edges defining a v-shaped notch; securing the periphery of the first planar sheet to the periphery of the second planar sheet; folding the first and second planar sheets to bring the first and second edges of the first cut-out portions of each of the first and second planar sheets into proximity with each other; securing the first and second edges of the first cut-out portions of each of the first and second planar sheets to each other; folding the first and second planar sheets to bring the first and second edges of the second cut-out portions of each of the first and second planar sheets into proximity with each other; and securing the first and second edges of the second cut-out portions of each of the first and second planar sheets to each other.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1A:
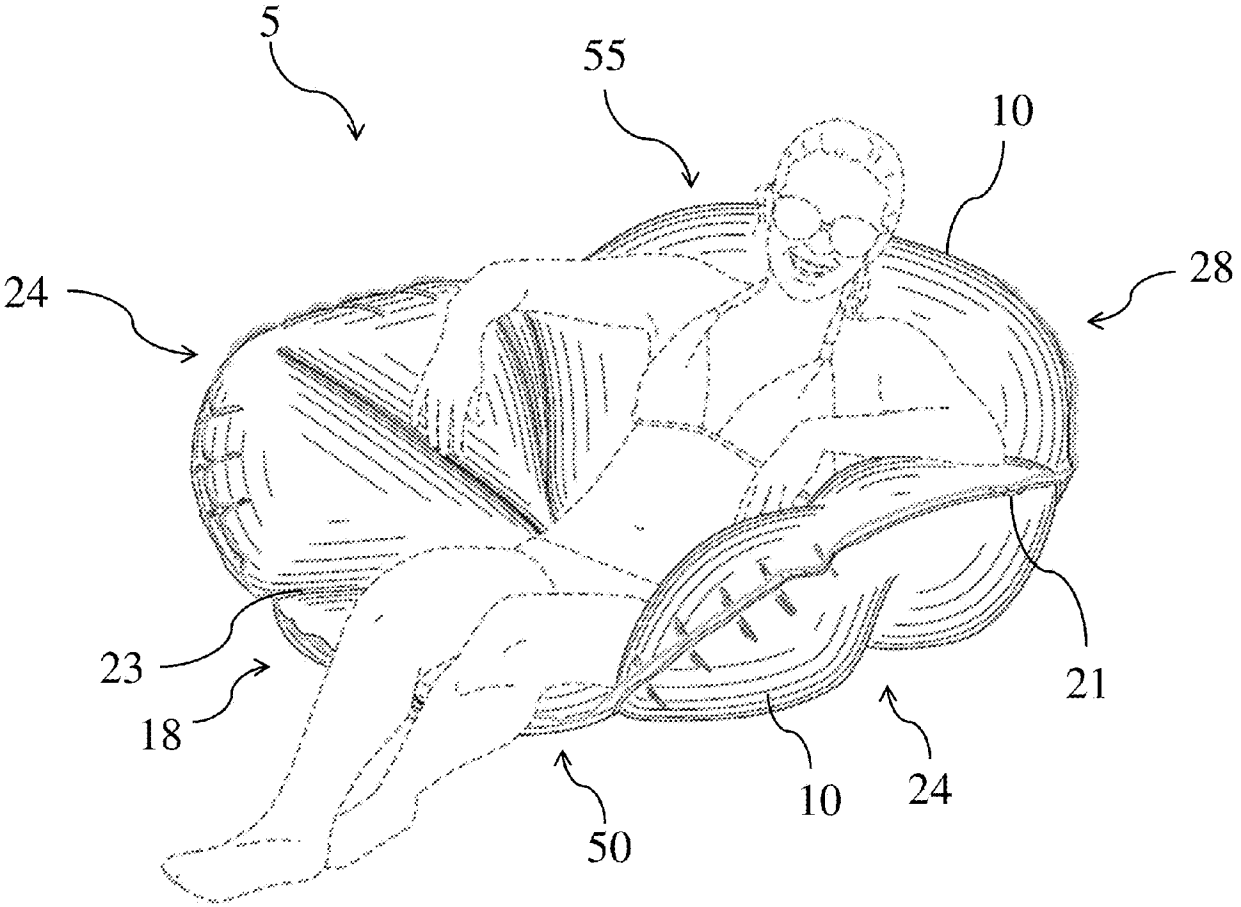
FIG. 1A is a perspective view of an inflatable lounge chair, in accordance with one or more embodiments.
Figure 1B:
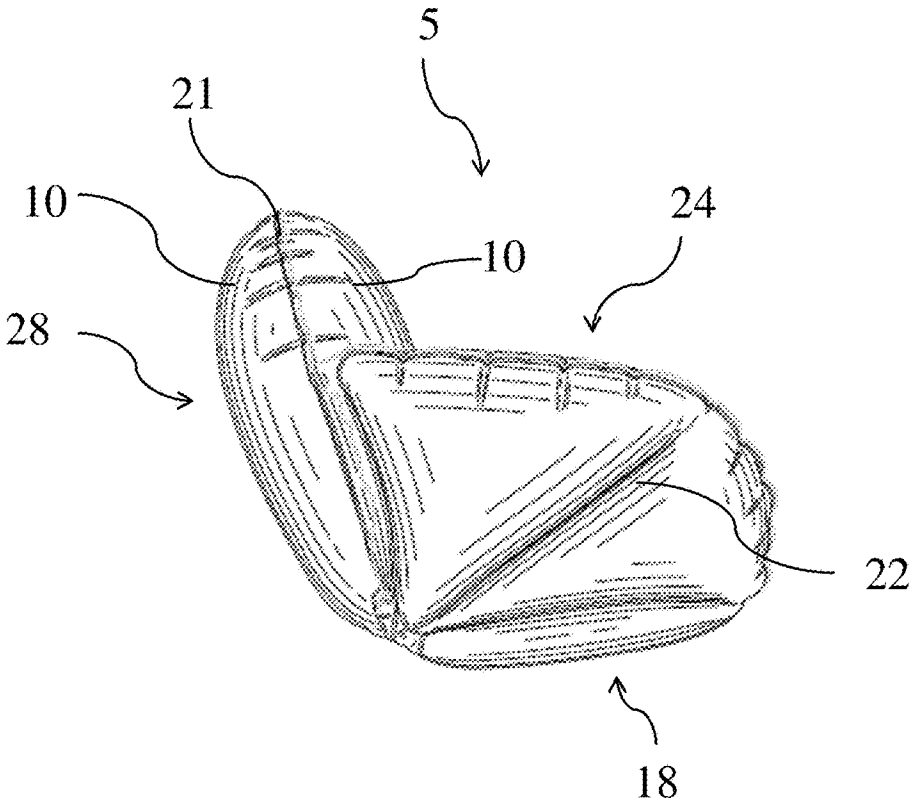
FIG. 1B is an elevational view of the inflatable lounge chair as seen from the left side of FIG. 1A, the right side elevational view being a mirror image thereof.
Figure 1C:
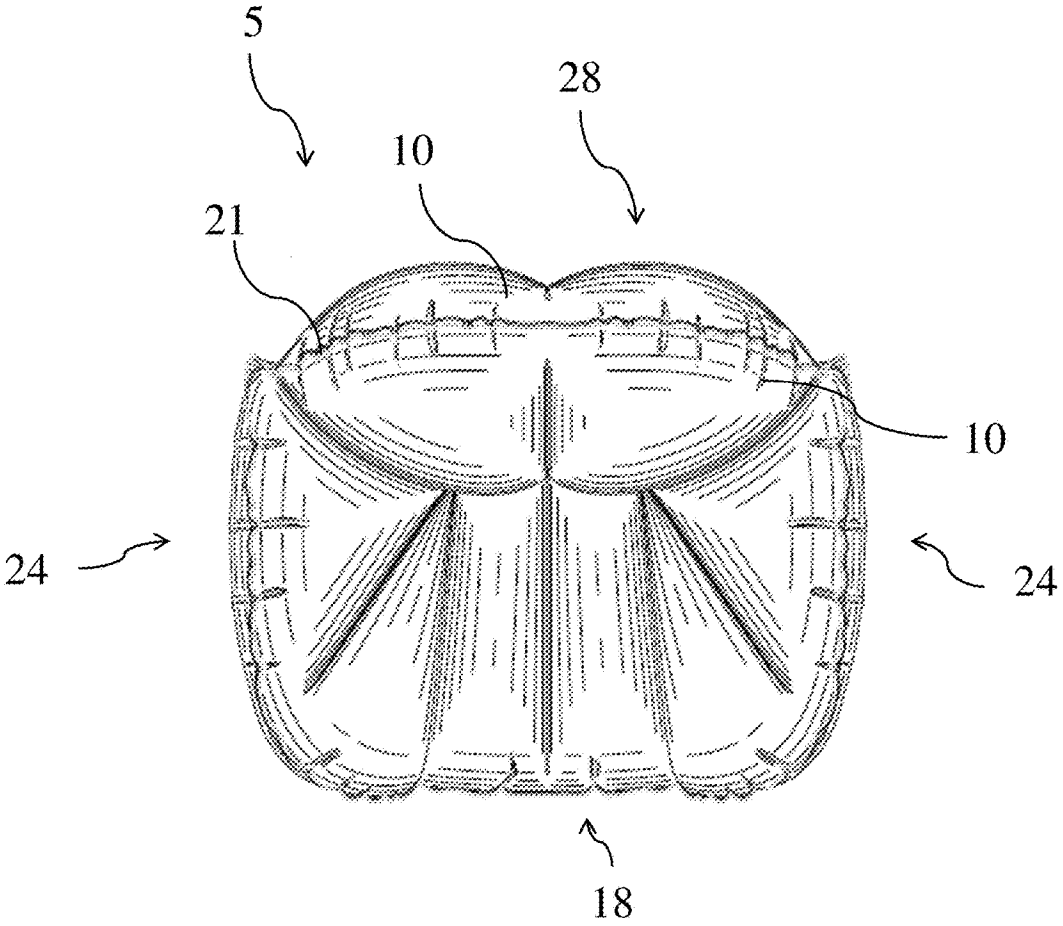
FIG. 1C is a top plan view of the inflatable lounge chair.
Figure 1D:
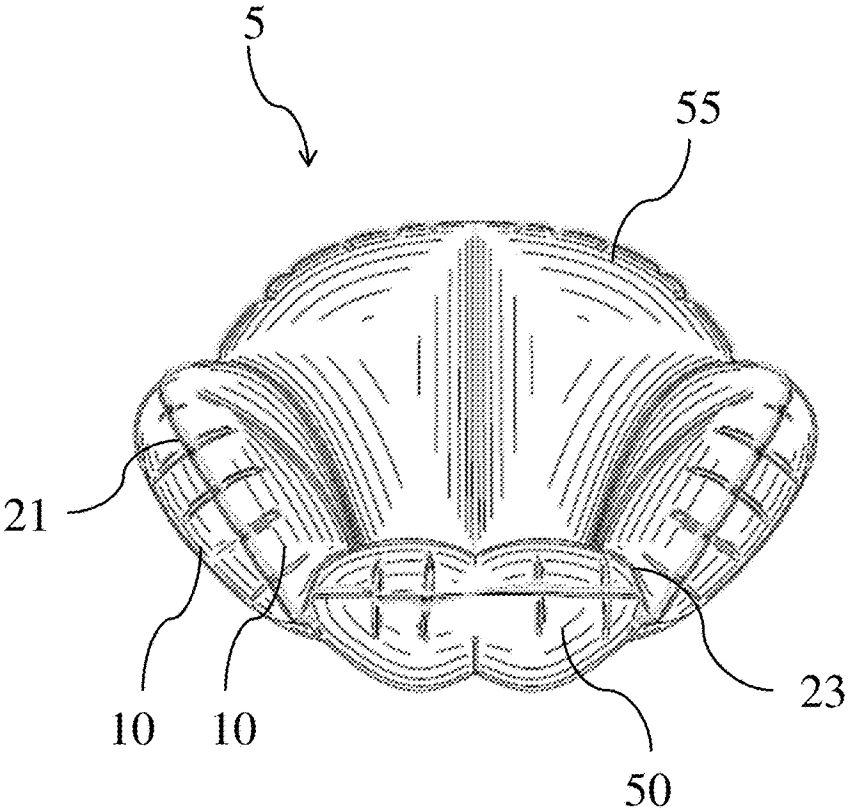
FIG. 1D is a front elevational view of the inflatable lounge chair.

The present disclosure provides a simpler, more economical, yet effective method of constructing an inflatable lounge chair.

According to one or more embodiments, one planar sheet is placed atop a second similarly shaped planar sheet, so that they may be welded together along their peripheries to form an inflatable bladder. By appropriately shaping and welding together the two sheets, as explained below, the uninflated bladder may be folded into a cup-like configuration having a seat portion, two side or arm portions, and a back portion, thus forming a floating lounge chair. Two additional welds will fix each side portion to the back portion to secure that bladder in that shape. As a result, fewer welding steps are required to form the chair.

Turning to the figures, as shown in FIGS. 1A-1D, an inflatable device made according to the method of the instant invention may be used as an inflatable lounge chair 5. The chair 5 comprises two planar sheets 10. A peripheral seam 21 (e.g. a welding seam) secures the two sheets 10 at their peripheries 40 to form a bladder. The planar sheets 10 are folded into a cup-shaped position with a seat portion 18, two side or arm portions 24, and a back portion 28. According to some embodiments, an interior seam 23, joining the two sheets 10 within their interior sections, defines the seat portion 18. The seat portion 18 may define a first inflatable region 50 of the chair 5. The first and second arm portions 24 and the back portion 28 may define a second inflatable region 55 of the chair 55. The first and second inflatable regions may be fluidically isolated from one another. The interior seam 23 may create the fluidic isolation.

Figure 2:
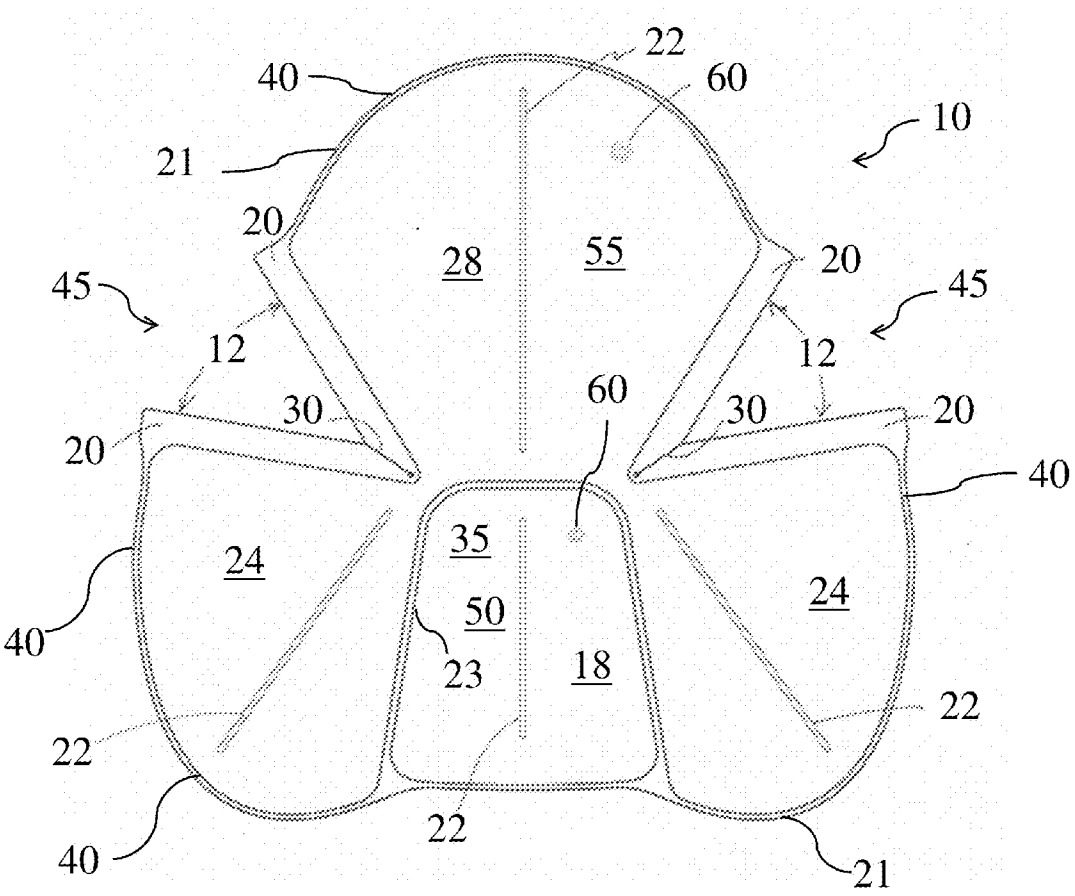
FIG. 2 is a drawing depicting the details of one of the two planar sheets that are welded together to form the chair.

FIG. 2 is a drawing depicting the details of one of the two planar sheets 10 that are secured (e.g. welded) together to form the chair 5. Because both sheets 10 are substantially similar, FIG. 2 represents either/both of the sheets 10.

The sheet 10 includes portions that will become the arm portions 24, the seat portion 18, and the back portion 28. The sheet comprises an interior section 35 and a periphery 40. The lines labeled 21 show where a peripheral seam will be formed, for example, through a welding process (which may include any appropriate heat-based joining process known in the art). The line labeled 23 shows where an interior seam may be formed. The interior seam 23 may define a seat portion 18 and an inflatable region 50 isolated from a separate inflatable region 55 defined by the arms and back portions 24 and 28. Separate inflation valves 60 may be used to inflate or deflate the two inflatable regions 50 and 55.

Two sets of edges or tabs 20 (shown in FIGS. 2-3) proximate to the periphery 40 of the sheets 10 may then be folded together and welded together to keep the chair 5 in the cup-shaped configuration shown in FIGS. 1A-1D.

The particulars of the construction technique may be understood by reference to FIG. 2, which depicts one of the two planar sheets 10, each made of a weldable plastic material such as PVC. According to certain embodiments, the sheet 10 is cut to provide two cut-out portions 45 each having first and second edges 20 defining a v-shaped notch 12. The cut-out portions 45 may be at approximately the three o'clock and nine o'clock positions, while other positioning is also possible. At the notches 12, the two sheets 10 are welded together in such a way as to leave a strip of material, or tab, on the edges 20 of the cut-out portions 45 on each side of each notch 12. The sheets 10 may now be folded into a cup-like shape by raising areas 24 and 28 to a position in which the edges 20 at each notch 12 overlap. The two edges 20 in each pair are then welded together to maintain the chair 5 in a cup-like position.

As shown in FIG. 2, at the vertex of each v-shaped notch 12 an inwardly directed slit 30 may be cut to facilitate the folding and welding operation. Each slit 30 may culminate in a small circular cut-out area that will prevent the edges 20 from tearing at the inward end of the slit 30.

According to certain embodiments, before the second plastic sheet 10 of substantially similar or identical shape is positioned over the first sheet 10, plastic beams may be positioned between the sheets 10 in the positions 22 shown in FIG. 2. For example, at least one plastic beam 22 may be positioned in each of the first and second arm portions 24, the back portion 28, and the seat portion 18. Such plastic beams 22 provide stability and maintain the chair 5 in the desired shape when it has been inflated. The beams 22 are then welded between and to each of the sheets 10 and the sheets 10 are secured together at their peripheries 40 to make the peripheral seam 21.

Figure 3:
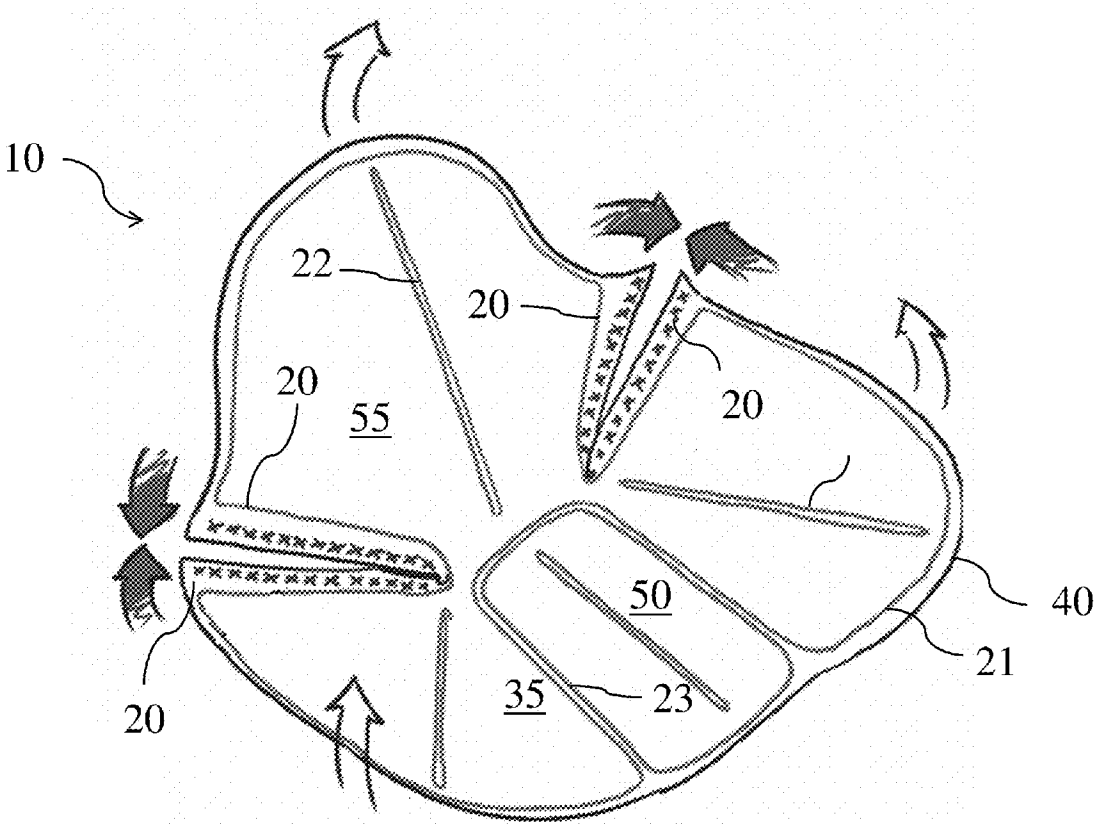
FIG. 3 is a drawing illustrating the folding of the bladder into a cup-like configuration, prior to the final welding steps.

FIG. 3 illustrates the folding of the sheets 10, as indicated by the directional arrow into a cup-like configuration so that the edges 20 may be welded together. According to one or more embodiments a method for manufacturing an inflatable lounge chair 5 is as follows. A periphery 40 of the first planar sheet 10 may be aligned with a periphery 40 of the second planar sheet 10. The first and second cut-out portions 45 of each of the first and second planar sheets 10 each comprise first and second edges 20 defining a v-shaped notch 12. The periphery 40 of the first planar sheet 10 may be secured to the periphery 40 of the second planar sheet 10, for example, through heat welding or a similar process. The first and second planar sheets 10 may be folded (as shown by the directional arrows in FIG. 3, for example) to bring the first and second edges 20 of the first cut-out portions 45 of each of the first and second planar sheets 10 into proximity with each other. The first and second edges 20 of the first cut-out portions 45 of each of the first and second planar sheets 10 may be secured to each other. These final steps may be repeated for the second cut-out portions 45 of each of the first and second planar sheets 10.

From the description of at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or"

as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An inflatable lounge chair, comprising:

first and second planar sheets, each comprising:

an interior section;

a periphery;

first and second cut-out portions proximate the periphery, each of the first and second cut-out portions comprising first and second edges defining a v-shaped notch; and a slit positioned at a vertex of each of the v-shaped notches; and a peripheral seam securing the first and second planar sheets at their peripheries, wherein the first and second planar sheets are folded such that the first and second edges of the first cut-out portions of each of the first and second planar sheets are in proximity with and secured to each other, and such that the first and second edges of the second cut-out portions of each of the first and second planar sheets are in proximity with and secured to each other.

2. The inflatable lounge chair of claim 1, wherein the peripheral seam and the first and second planar sheets define first and second arm portions, and a back portion.

3. The inflatable lounge chair of claim 2, further comprising an interior seam securing the first and second planar sheets to each other within their interior sections to define a seat portion.

4. The inflatable lounge chair of claim 3, further comprises a plurality of plastic beams positioned between and secured to the first and second planar sheets, with at least one of the plurality of plastic beams positioned in each of the first and second arm portions, the back portion, and the seat portion.

5. The inflatable lounge chair of claim 3, wherein the seat portion defines a first inflatable region.

6. The inflatable lounge chair of claim 5, wherein the first and second arm portions and the back portion define a second inflatable region.

7. The inflatable lounge chair of claim 6, wherein the first inflatable region is fluidically isolated from the second inflatable region.

8. A method of manufacturing an inflatable lounge chair, comprising:

aligning a periphery of a first planar sheet with a periphery of a second planar sheet, wherein first and second cut-out portions of each of the first and second planar sheets each comprise first and second edges defining a v-shaped notch;

securing the periphery of the first planar sheet to the periphery of the second planar sheet;

folding the first and second planar sheets to bring the first and second edges of the first cut-out portions of each of the first and second planar sheets into proximity with each other;

securing the first and second edges of the first cut-out portions of each of the first and second planar sheets to each other;

folding the first and second planar sheets to bring the first and second edges of the second cut-out portions of each of the first and second planar sheets into proximity with each other;

securing the first and second edges of the second cut-out portions of each of the first and second planar sheets to each other; and securing the first planar sheet to the second sheet at an interior section to define a seat portion, wherein the seat portion defines a first inflatable region fluidically isolated from a second inflatable region defined by first and second arm portions and a back portion.

9. The method of claim 8, further comprising positioning plastic beams between the first and second planar sheets and securing the plastic beams to the first and second planar sheets, such that at least one plastic beam is positioned in each of a first arm portion, a second arm portion, a seat portion, and a back portion.

10. A method of manufacturing an inflatable lounge chair, comprising:

aligning a periphery of a first planar sheet with a periphery of a second planar sheet, wherein first and second cut-out portions of each of the first and second planar sheets each comprise first and second edges defining a v-shaped notch;

positioning plastic beams between the first and second planar sheets and securing the plastic beams to the first and second planar sheets, such that at least one plastic beam is positioned in each of a first arm portion, a second arm portion, a seat portion, and a back portion;

securing the periphery of the first planar sheet to the periphery of the second planar sheet;

folding the first and second planar sheets to bring the first and second edges of the first cut-out portions of each of the first and second planar sheets into proximity with each other;

securing the first and second edges of the first cut-out portions of each of the first and second planar sheets to each other;

folding the first and second planar sheets to bring the first and second edges of the second cut-out portions of each of the first and second planar sheets into proximity with each other; and securing the first and second edges of the second cut-out portions of each of the first and second planar sheets to each other.

* * * * *